United States Patent [19]

Johansson

[11] Patent Number: 4,545,425

[45] Date of Patent: Oct. 8, 1985

[54] MOUNTING DEVICE

[76] Inventor: Kjell Johansson, Styrmansgatan 19, Falkenberg, Sweden

[21] Appl. No.: 276,475

[22] Filed: Jun. 23, 1981

[30] Foreign Application Priority Data

Jun. 25, 1980 [SE] Sweden ..... 8004680

[51] Int. Cl.[4] ..... F28D 11/02; F28F 5/02; B60B 7/06

[52] U.S. Cl. ..... 165/89; 29/117; 29/123; 29/129

[58] Field of Search ..... 165/89; 29/110, 117, 29/119, 123, 129, 148.4 D; 34/124, 125

[56] References Cited

U.S. PATENT DOCUMENTS

| | | | |
|---|---|---|---|
| 907,300 | 12/1908 | Sturtevant | 29/117 |
| 1,392,626 | 10/1921 | Cox | 165/89 |
| 2,326,044 | 8/1943 | Littleton | 165/89 |
| 2,538,499 | 1/1951 | Benoit | 29/119 |
| 2,718,155 | 9/1955 | Firth | 29/148.4 D |
| 2,736,205 | 5/1956 | Dunne | 198/842 |
| 2,752,632 | 7/1956 | Winstead | 29/123 |
| 2,936,158 | 5/1960 | Ramundo | 165/89 |
| 2,984,954 | 5/1961 | Burt | 29/119 |
| 3,217,794 | 11/1965 | Meyer et al. | 165/89 |
| 3,406,748 | 10/1968 | Jarreby | 165/89 |
| 3,581,659 | 6/1971 | Bryer | 29/123 |
| 4,156,958 | 6/1979 | Miesch | 29/117 |
| 4,181,217 | 1/1980 | Huls et al. | 29/117 |
| 4,232,834 | 11/1980 | Player et al. | 29/123 |
| 4,235,002 | 11/1980 | Pav et al. | 165/89 |

FOREIGN PATENT DOCUMENTS

| | | | |
|---|---|---|---|
| 1132323 | 6/1962 | Fed. Rep. of Germany | 165/89 |
| 215887 | 6/1961 | Netherlands | 29/117 |
| 225376 | 12/1924 | United Kingdom | 29/123 |

*Primary Examiner*—William R. Cline
*Assistant Examiner*—John K. Ford
*Attorney, Agent, or Firm*—Robert W. Doyle

[57] ABSTRACT

The present invention relates to a device for mounting an outer jacket (4) on a roller-shaped body (1, 2, 3) for forming an annular space (5) between the outer jacket (4) and the roller-shaped body (1, 2, 3). The basis of the present invention resides in the task of simplifying, to as high a degree as possible, the prior art devices of this type, and, as far as is possible, obviating or at least reducing the inconveniences inherent therein. This task is solved according to the present invention, in that the device is provided with at least one slotted ring (19) at each end of the outer jacket (4) and the roller-shaped body (1, 2, 3) in the space (5) therebetween, the ring (19) having at least one inclined surface (20) for cooperation with an inclined surface (10) on the jacket (4) or the body (1, 2, 3) for radial movement of the ring (19) on actuation thereof into the space by means of adjustment screws (22) in a nut (11) which is secured against axial movement.

4 Claims, 4 Drawing Figures

MOUNTING DEVICE

TECHNICAL FIELD

The present invention relates to a device for mounting an outer jacket on a roller-shaped body for forming an annular space between the outer jacket and the roller-shaped body.

THE STATE OF THE ART

Prior art devices of the above-mentioned type are illustrated in U.S. Pat. No. 2,736,205 and Swedish Patent Specification No. 313,732 which both relate to devices for mounting an outer jacket on a roller-shaped body. The device according to the Swedish patent also realises a sealing closure of a space between the outer casing and the roller-shaped body. However, both of these prior art devices are based on a construction having two slotted, conical rings with an interjacent abutment member for realising radial movement of the slotted rings for fixation of the outer jacket on the roller-shaped body. A great inconvenience inherent in these prior art devices is the requisite high number of carefully machined and mutually cooperating parts, which entails relatively high manufacture and assembly costs. Moreover, the alternatives for influencing the circumference shape of the outer jacket are restricted. Furthermore, in the device disclosed in Swedish Pat. No. 313,732, a relatively complicated sealing member is required which renders the entire device more expensive.

TECHNICAL PROBLEM

The basis of the present invention resides in the task of simplifying, to as high a degree as possible, the prior art devices and, as far as is possible, obviating or at least reducing the inconveniences inherent in them.

SOLUTION

The above-mentioned task is solved according to the present invention in that the device disclosed by way of introduction is characterised by at least one slotted ring at each end of the outer jacket and the roller-shaped body in the space therebetween, the ring having at least one inclined surface for cooperation with one inclined surface on the jacket or body for radial movement of the ring on actuation thereof at least into, and possibly out of, the space by means of adjustment screws in a nut which is secured against axial movement. The inclined surface of the ring is located on the radial inner face, whereas the inclined surface of the roller-shaped body is located on the end of the radial outer face in the form of a bevel. The nut is common to all adjustment screws and is in the form of a ring secured to the roller-shaped body and having a threaded accommodation for each adjustment screw. The pressure ring has through-holes in alignment with pressure screws disposed in the nut ring for actuation thereof through the holes and urging them against the pressure ring in a direction from the nut ring. In the event that the space is intended for a coolant and the roller-shaped body is in the form of an innerjacket mounted on a through shaft or on sub shafts, the exterior face of the nut ring displays a seat for one or more sealing rings and a ring for urging the sealing rings into sealing abutment against the seat and the outer jacket. The pressure ring has accommodation apertures for the adjustment screws, the apertures in register with the pressure screws being less than the diameter of the pressure screws, for which pressure screws the nut ring has threaded accommodation.

ADVANTAGES

As a result of the present invention, the number of parts in the mounting device is reduced considerably, and, moreover, the construction is improved to a great degree when the device is applied in a coolant roller and, consequently, the securing proper is not exposed to the axial forces exercised by the coolant in the space between the jackets. In a roller whose diameter is 700 mm, the axial forces can amount to almost 6,000 kp in a coolant pressure of 6 kp/cm$^2$. Normally, the coolant is water. The circumference of the outer jacket will not, thus be influenced by the coolant pressure (via the securing connection), since the axial force is absorbed by the fixed locking ring and the sealing arrangement cooperating therewith, which is considerably simpler in the device according to the invention than in prior art devices. In a sealing arrangement according to the present invention, the use of conventional O-rings is permitted. Furthermore, the anchorage connection according to the present invention permits influence of the circumference of the outer jacket in a considerably simpler fashion than is the case in conventional constructions, since "high" positions on the outer jacket can be lowered by means of the pressure screws disposed on the inside of the slotted rings.

DESCRIPTION OF THE ACCOMPANYING DRAWINGS

In the accompanying drawings.

Figure 1:
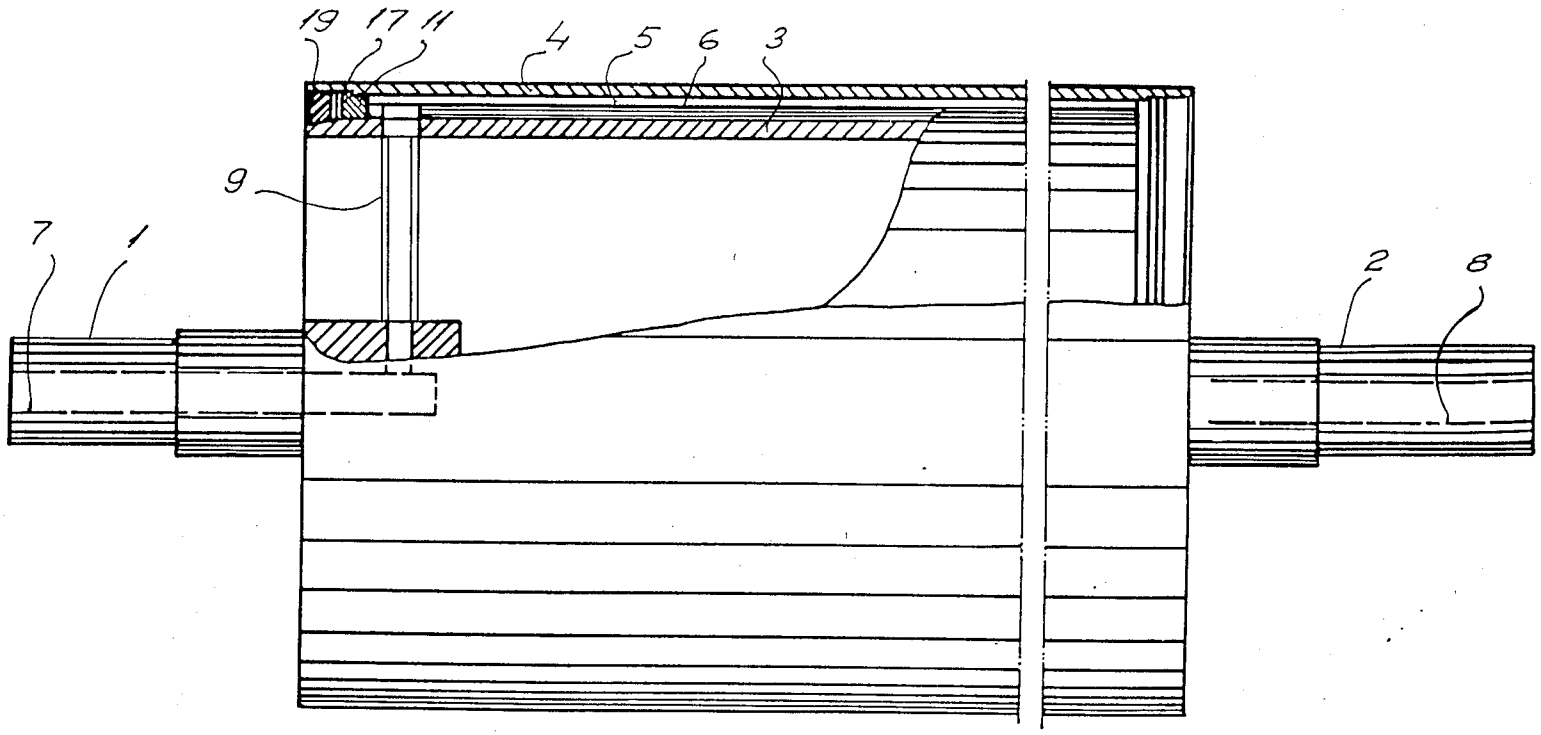
FIG. 1 is a side elevation partly in section of a cooling roller with a device according to one embodiment of the present invention.

The nature of the present invention and its aspects will be more readily understood from the following more detailed description with reference to the accompanying drawings. FIG. 1 shows a cooling roller with a stub shaft 1, 2 at each end thereof. The stub shafts 1 and 2 may, naturally, be stub shafts on a through shaft, but in the present case, the stub shafts are connected to an inner jacket 3 by the intermediary of spokes (not shown) which extend between the stub shafts 1, 2 and the jacket 3 in a manner which is conventionally known per se.

On the roller-shaped body formed by the stub shafts 1 and 2 and the inner jacket 3, an outer jacket 4 is mounted in such a manner that a space 5 is created between the inner jacket 3 and the outer jacket 4. Insulating material 6 is disposed on the inner jacket. The space 5 is in communication with an inlet 7 to the stub shaft 1 and an outlet 8 from the stub shaft 2 by the intermediary of suitable connections of which one is shown at 9 in FIG. 1. Naturally, it is obvious that a fundamentally similar connection is disposed between the space 5 and the outlet 8 on the stub shaft 2.

If necessary, volume-restricting guide members may be disposed in the space 5, whose purpose is to realise as even a temperature in the outer jacket 4 as possible in the longitudinal direction of the roller. It should here be pointed out that the roller might just as well be a heating roller as a cooling roller.

Figure 2:
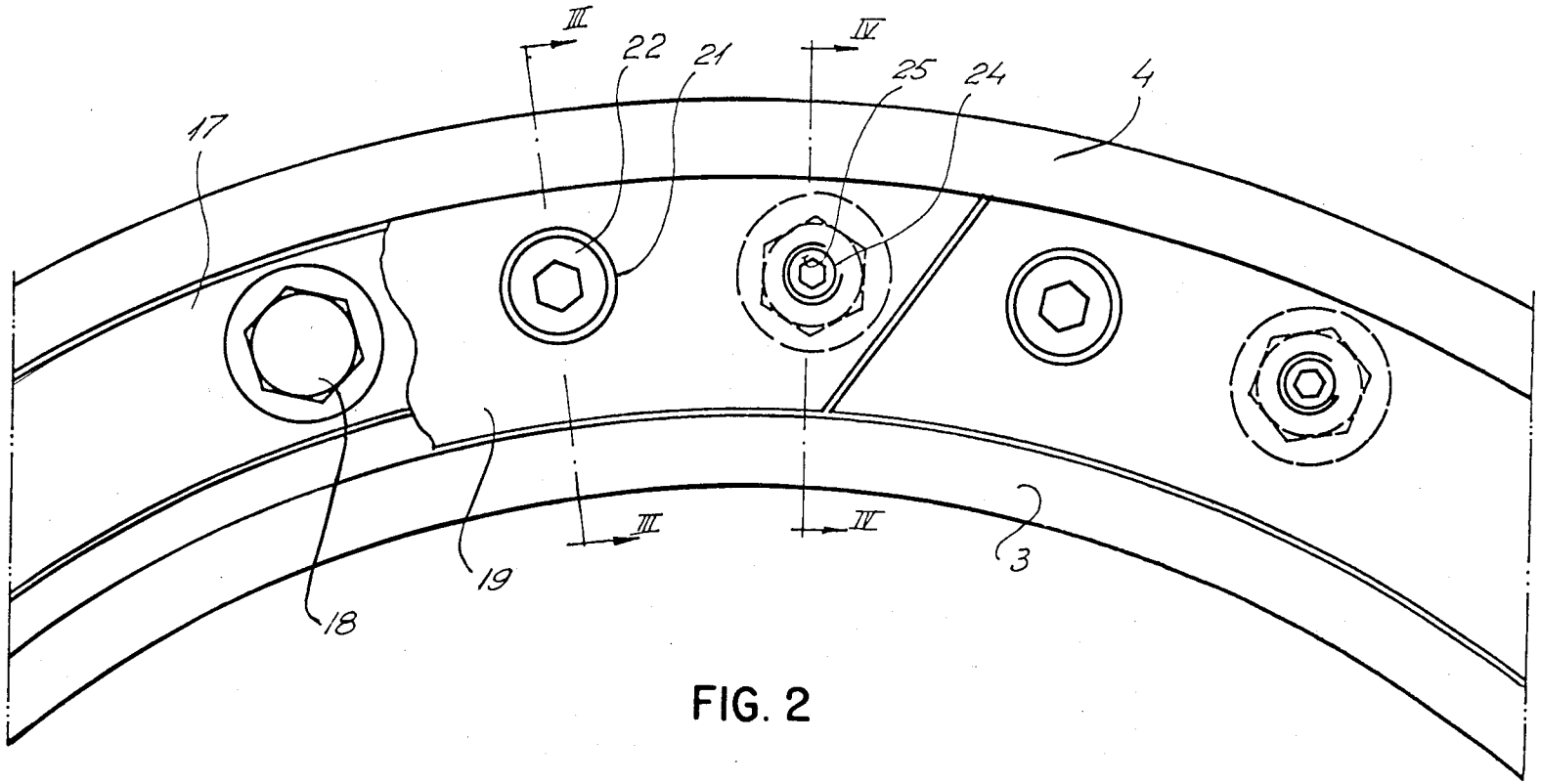
FIG. 2 shows on a larger scale, an end elevation of a part of the device according to FIG. 1, with a section partly exploded.
Figure 3:
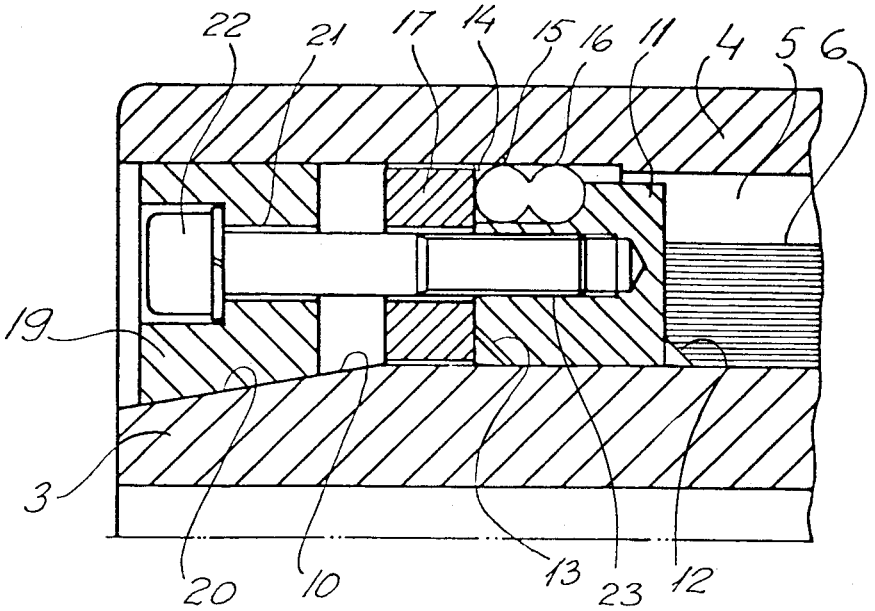
FIG. 3 shows a section taken along the line III—III in FIG. 2.

The outer jacket 4 is disposed on the inner jacket or that roller-shaped body formed by the stub shafts 1, 2 and the inner jacket 3, by means of the arrangement shown in greater detail in FIGS. 2 and 3.

Figure 4:
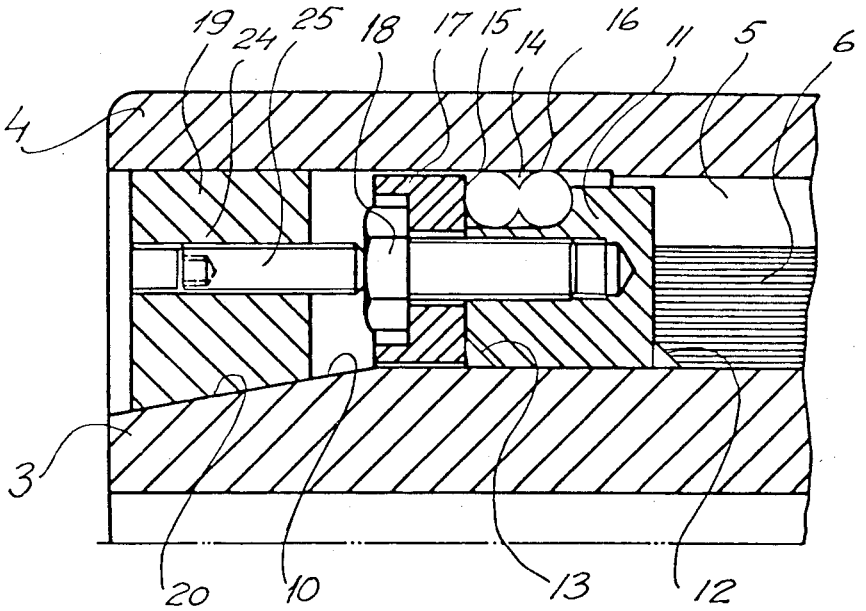
FIG. 4 is a section taken along the line IV—IV in FIG. 2.

Both ends on the inner jacket 3 display an inclined surface 10 which may be described as having the form of a relatively elongate bevel. Within the bevel 10, a nut ring 11 is anchored on the inner jacket 3 in some suitable manner for example by welding. FIGS. 3 and 4 show two welding joints 12 and 13 and, furthermore, also a section of the insulating material 6. On the diagonally outer section of the nut ring 11, a seat 14 is disposed for sealing rings 15 and 16, which may consist of per se conventional O-rings which are to realise sealing between the seat 14 and outer jacket 4 against leackage of the medium located in the space 5 irrespective of whether this is a coolant or a heating medium.

In this context, it should be observed that in the event the roller is a coolant roller having a diameter of 700 mm, the axial force on the nut ring 11 (and thereby partly on the sealing arrangement) will be in the region of 6,000 kp at a coolant pressure of 6 kp/cm$^2$.

For retaining the sealing rings 15 and 16 in the seat 14, and possibly also sealing deformation of the sealing rings 15 and 16, a sealing washer or sealing urging means 17 is provided. The washer 17 is of such dimension as preferably to become positioned within the inclined surface 10 on the inner jacket 3. The washer 17 is urged against the nut ring 11 by means of screws 18 (FIGS. 3 and 4).

For securing the outer jacket 4 on the inner jacket 3, a slotted ring 19 is disposed in the space between the jackets outside the nut ring 11 and the ring 17. It should here be observed that the ring 19 may have one or more slots. On its radial inner face, the ring 19 has an inclined surface 20 for cooperation with the inclined surface 10 on the inner jacket 3. Through holes 21 are provided in the ring 19 the through holes preferably being countersunk for the head of a screw 22 which extends through a free hole in the washer or ring 17 in a threaded accommodation 23 in the nut ring 11. Further threaded accommodations 24 are provided in the ring 19, these being, as is apparent from FIG. 4, located in register with the screws 18 and being intended for screws 25 for abutment against the head of the screws 18. The ring 19 may, thus, be positioned by means of both the screws 22 and the screws 25. The screws 22 and 25 are, as is illustrated, of the internal hexagonal type, whereas the screws 18 are of the normal hexagonal type. Naturally, the screws 18 could equally well be of the internal hexagonal type. The screws 22 may be considered as adjustment screws, whereas the screws 25 are to be considered as pressure screws.

By the application of both adjustment screws 22 and pressure screws 25, adjustment and positioning of the outer jacket 4 are facilitated to a great extent on the inner jacket 3. Primarily, this is taken to relate to the circumference or roundness of the outer jacket 4. For example, high positions on the jacket 4 may be lowered by means of the pressure screws 25 without the need for the whole of or large parts of the ring 19 to be urged into the space between the jackets by means of the pressure screws 22, which has hitherto been necessary.

Mounting of the apparatus is preferably effected in such a manner that, once the sealing rings 15 and 16 are mounted on the seat 14, the washer 17 is lodged in place and urged against the nut ring 11 by means of the screws 18. Thereafter, the pressure screws 25 are inserted and are screwed down so far that the ring 19 may be brought into place in the space between the jackets 3 and 4 without the screws' 25 coming into contact with the heads on the screws 18. Thereafter the adjustment screws 22 are screwed in place and tightened for suitable positioning of the jacket 4 with respect to the jacket 3. Possible unevenesses in the roundness of the jacket 4 may thereafter be evened out by means both of the adjustment screws 22 and the pressure screws 25, which, in this case, are withdrawn for abutment on the ring 21 in an axial outward direction.

Division between the screws included in the device, and the number of screws may be selected according to need. Similarly, the ring 19 may be divided into several parts by means of slots.

Furthermore, it is conceivable to place the inclined surface 10 on the inner face of the outerjacket 4 and the inclined surface 20 on the radial outer face of the ring 19. It is also possible within the spirit and scope of the present invention to replace the screws 25 by means of screws located in the ring 17 or rings 11 and 17, these being reached through holes in the ring 19 and screwed outwardly into abutment against the inner face of the ring 19 and urging thereof outwardly.

I claim:

1. The structure for providing an annular space, fluid retaining area about a roller-shaped body, which body is normally mounted for rotation on a shaft structure, the resultant structure providing a singular structure, the structure including:

a. a jacket having an inner shape and size to provide an annular space interiorally thereof when positioned about the roller shaped body;

b. a nut ring positioned respectively on each of the ends of the roller body and secured thereto to prevent axial movement thereof and being provided with a plurality of circumferentially spaced, blind passages therein;

c. at least certain of said passages being threaded to receive threaded attachment members therein as received from the respective ends of said roller body;

d. said nut ring being provided with a sealing ring receiving seat about the outer periphery thereof, said surface being directed outwardly towards the inner surface of said jacket;

e. at least one compressible sealing member arranged on said sealing ring receiving seat to seal between said nut ring and said inner surface of said jacket;

f. a compression ring arranged for positioning against said nut ring for compression of said sealing member, said compression ring providing a plurality of circumferentially spaced passages therethrough;

g. certain of said passages being threaded for receiving threaded attachment elements into said compression ring;

h. certain of said compression ring passages providing accommodation and aperture, passing openings for threaded attachment elements to be threadedly received into said nut ring;

i. a plurality of threaded attachment elements received through said compression ring passages and into said nut ring for compression of said sealing member and sealing thereof to said nut ring and said jacket;

j. a tapered surface being provided selectively on the respective ends of one of said roller body and said jacket;

k. a split ring member having a mating tapered surface thereon to mate with said selected body and jacket tapered surface;

l. said split ring member having a plurality of circumferentially spaced passages axially therethrough;

m. certain of said split ring passages being threaded;

n. certain of said split ring passages providing accomodation and attachment element openings for threaded attachment elements to be threadedly received in said nut ring;

o. said threaded passages of said split ring being arranged in axial alignment with said accomodation openings of said compression ring and said accomodation openings of said split ring being in axial alignment with said threaded passages of said compression ring whereby succeeding the placement of and tightening of said compression ring to said nut ring for sealing compression of said sealing member, said split ring may be axially positioned with respect to said roller body and said jacket to provide an unitary structure.

2. The structure set forth in claim 1 wherein said taper is provided on the inner surface of said jacket and is respectively provided on the outer periphery of said split ring.

3. The structure set forth in claim 1 wherein said taper is provided on the outer surface of said roller body and is respectively provided on the inner periphery of said jacket.

4. The structure set forth in claim 1 wherein said threaded passages, openings and threaded attachment elements are identically threaded.

* * * * *